US007090557B1

(12) United States Patent
Ainsworth, Jr. et al.

(10) Patent No.: US 7,090,557 B1
(45) Date of Patent: Aug. 15, 2006

(54) ORNAMENTAL DISPLAY USING WIND MOTION

(76) Inventors: Thomas Ainsworth, Jr., 2359 Hidden Meadows Dr., Sun Prairie, WI (US) 53590; Daniel T. Hefty, 2513 E. Dayton St., Madison, WI (US) 53704

( * ) Notice: Subject to any disclaimer, the term of this patent is extended or adjusted under 35 U.S.C. 154(b) by 0 days.

(21) Appl. No.: 10/943,381

(22) Filed: Sep. 17, 2004

(51) Int. Cl.
*A63H 33/40* (2006.01)

(52) U.S. Cl. ..... 446/487; 446/176; 446/227; 446/268

(58) Field of Classification Search ..... 446/80, 446/79, 487, 488, 49, 176, 199, 227, 268; 116/173, 26, 265; 43/1–3, 42.15, 42.16, 43/42.17, 42.18; D21/599; 160/135, 230
See application file for complete search history.

(56) References Cited

U.S. PATENT DOCUMENTS

| | | | | |
|---|---|---|---|---|
| 278,461 | A | 5/1883 | Sereven | |
| 1,159,056 | A * | 11/1915 | Lundborg et al. | |
| 1,557,644 | A * | 10/1925 | Anderson | |
| 2,763,952 | A | 9/1956 | Bruce | |
| 2,851,814 | A * | 9/1958 | Lutz | |
| 3,229,407 | A * | 1/1966 | Quyle | |
| 3,271,897 | A | 9/1966 | Gelinas | |
| 3,492,755 | A * | 2/1970 | Sundblad | |
| 3,800,457 | A | 4/1974 | Barrett | |
| D265,074 | S * | 6/1982 | Ornatek | D11/166 |
| 4,462,145 | A * | 7/1984 | Schulze | 29/428 |
| 4,578,888 | A | 4/1986 | Gomez | |
| 4,651,457 | A | 3/1987 | Nelson et al. | |
| 4,662,851 | A * | 5/1987 | Foster | 441/129 |
| 4,852,288 | A | 8/1989 | Payne et al. | |
| 4,890,571 | A * | 1/1990 | Gaskill | 116/22 A |
| 4,893,428 | A | 1/1990 | Gagnon, Sr. | |
| 4,936,041 | A * | 6/1990 | Couture | 43/42.15 |
| 4,965,953 | A | 10/1990 | McKinney | |
| 5,003,722 | A | 4/1991 | Berkley et al. | |
| 5,096,204 | A * | 3/1992 | Lippman | 273/285 |
| 5,274,942 | A | 1/1994 | Lanius | |
| 5,279,063 | A | 1/1994 | Heiges | |
| 5,289,654 | A | 3/1994 | Denny et al. | |
| 5,491,851 | A * | 2/1996 | Alonso | 5/722 |
| 5,515,637 | A | 5/1996 | Johnson | |
| 5,515,900 | A * | 5/1996 | West et al. | 160/135 |
| 6,085,452 | A * | 7/2000 | Davis | 40/607.03 |
| 6,179,683 | B1 | 1/2001 | Pell et al. | |
| 6,206,747 | B1 | 3/2001 | Skwarek | |
| 6,338,211 | B1 * | 1/2002 | Carney | 40/124.5 |
| 6,397,451 | B1 * | 6/2002 | Gill | 29/469.5 |
| 6,592,424 | B1 | 7/2003 | Christianson | |
| 6,733,357 | B1 | 5/2004 | Weiser | |
| 6,769,950 | B1 * | 8/2004 | Suciu | 446/176 |
| 6,907,688 | B1 * | 6/2005 | Brint | 43/2 |
| 2004/0128888 | A1 * | 7/2004 | Payan et al. | 40/610 |
| 2005/0039363 | A1 * | 2/2005 | Galey | 40/607.03 |

* cited by examiner

*Primary Examiner*—John A. Ricci
(74) *Attorney, Agent, or Firm*—DeWitt Ross & Stevens SC; Charles S. Sara

(57) ABSTRACT

A mobile constructed from a single sheet of material having alternating cut lines and fold lines so that wind striking the mobile causes the intervening panels to undulate.

19 Claims, 2 Drawing Sheets

ORNAMENTAL DISPLAY USING WIND MOTION

FIELD OF THE INVENTION

The present invention relates to outdoor displays, particularly ornaments configured to undulate in the wind.

BACKGROUND OF THE INVENTION

Devices that model the appearance and simulate the movement of land or sea animals include ornaments, decoys, lures, and wind direction indicators. Such devices (such as figurines) generally fall into one of four categories: (1) those that rotate about a rod, (2) those that appear as stationary silhouettes, (3) those having bodies that sway or bounce in the wind, or (4) those that undulate in the wind.

Referring to the first three categories identified above, there have been numerous designs employed. For example, U.S. Pat. No. 4,965,953 to McKinney discloses a fowl decoy whose body is pivotally connected to a stand and whose neck and body are connected together with a mechanism including tension strings. The mechanism is complex and must be installed in the body of the fowl by an assembler. A string tied to the mechanism is tugged and relaxed by a remotely positioned person. However, if pulling the string is discontinued, the decoy just stands there looking like an unanimated decoy.

U.S. Pat. No. 5,279,063 to Heiges discloses a decoy simulating a fowl having a neck fastened at a first end to a ball that is set in the decoy body for universal movement, and fastened to a rotatably mounted head of the fowl at a second end. The neck is comprised of a long multiple-turn tightly wound helical spring with a plastic sheet around it.

U.S. Pat. No. 5,274,942 to Lanius has the head and neck of a fowl decoy pivotally connected to a body. A cord is attached to the head of the decoy and the cord has a weight fastened to it which tends to restore the neck of the decoy to its high position. A person situated remotely may tug on a string to cause the neck and head to bow. When the string tension is relieved the weight restores the neck and head to an upright attitude.

U.S. Pat. No. 5,289,654 to Denny discloses a wild fowl decoy such as a turkey, the body of which contains electric motors that are operatively coupled to the head and neck. The motors are actuated by electric signals from a remote transmitter.

U.S. Pat. No. 6,206,747 to Skwarek discloses a wind indicator having multiple sections including a tail section for catching wind, a front section for indicating the direction of the wind, a tail mounting section, a joiner for joining the tail mounting section with the front section, vanes for catching the wind, projections that fit into disk type structures, and a pole upon which the assembly rotates.

U.S. Pat. No. 4,852,288 to Payne et al. discloses a decoy resembling an animal. Parts of the decoy's anatomy, such as the neck, head, ears, and tail are connected in a pivotable articulated manner to the main body. String is connected to the body parts which move if the string is tugged. The body parts are restored to a resting position as a result of being connected to the ends of rubber bands having ends anchored to the body. Unless the string is tugged and relaxed, the decoy has little advantage over a figurine. The construction is complex and expensive to manufacture. Moreover, its complexity and several moving parts increase the likelihood of a breakdown.

Turning now to the fourth category discussed above, devices configured to undulate in the wind simulate to a greater extent the movement of fish, birds, and the like, and are displayed in places such as lawns, patio areas, in front of windows, or even inside houses near open windows. Although there are numerous prior art embodiments within the first three categories, the field of undulating ornaments/decoys is quite limited and presently incorporates compound design structures.

An undulating mobile is disclosed in U.S. Pat. No. 4,578,888 to Gomez. The '888 patent discloses a fish-shaped mobile or "wind sculpture" wherein a fish is segmented into sections and the sections are joined by a string. The mobile further incorporates weights secured to the segmented portions to maintain a vertical arrangement and draw the strings taunt. Due to the discontinuity between sections, the fish sways in the wind. Because of the numerous string attachments in the mobile, as well as balancing of the weights, assembly is tedious. Also, the assembly of numerous parts increases cost.

Therefore, there exists a need in the art for an undulating mobile that comprises few parts and is easily constructed.

SUMMARY OF THE INVENTION

The present invention is an undulating mobile, the primary characteristic of which is construction from a single/continuous sheet of material. Optional components include a display rod and a mounting base. The mobile is animated by wind blowing across panels interconnected by fold lines along the length of the material. The mobile may be displayed outdoors or indoors, provided there is sufficient wind. For example, the display apparatus 100 may be placed in an indoor plant box located near an open window.

The mobile of the present invention comprises a first panel having a first panel front side and a first panel back side; a second panel having a second panel front side and a second panel back side; a third panel having a third panel front side and a third panel back side; wherein said first panel front side and said second panel front side share a fold line and said first panel back side and said second panel back side abut a cut line; and wherein said second panel front side and said third panel front side abut a cut line and said second panel back side and said third panel back side share a fold line.

The mobile of the present invention also comprises a sheet of corrugated plastic having a front side and a back side; and a series of panels defined by cut lines along the length of the sheet, alternating on said front side and said back side.

The invention is also directed to an undulating mobile comprising: a plurality of panels; and linking means for consecutively linking the panels.

The invention is also directed to a mobile comprising a sheet of corrugated plastic having a front side and a back side; and a series of panels defined by cut lines along the length of the sheet, alternating on said front side and said back side.

The mobile/ornament of the present invention is generally two-dimensional and may take the form of a variety of animals or objects. For convenience, throughout the specification, a fish will be intermittently discussed or referenced as the mobile. It is to be understood however that the mobile can take on the form of any animal, object or ornamental design.

Objects and advantages of the invention will appear more fully from the following detailed description and accompanying drawings.

DETAILED DESCRIPTION OF THE INVENTION

Figure 1:
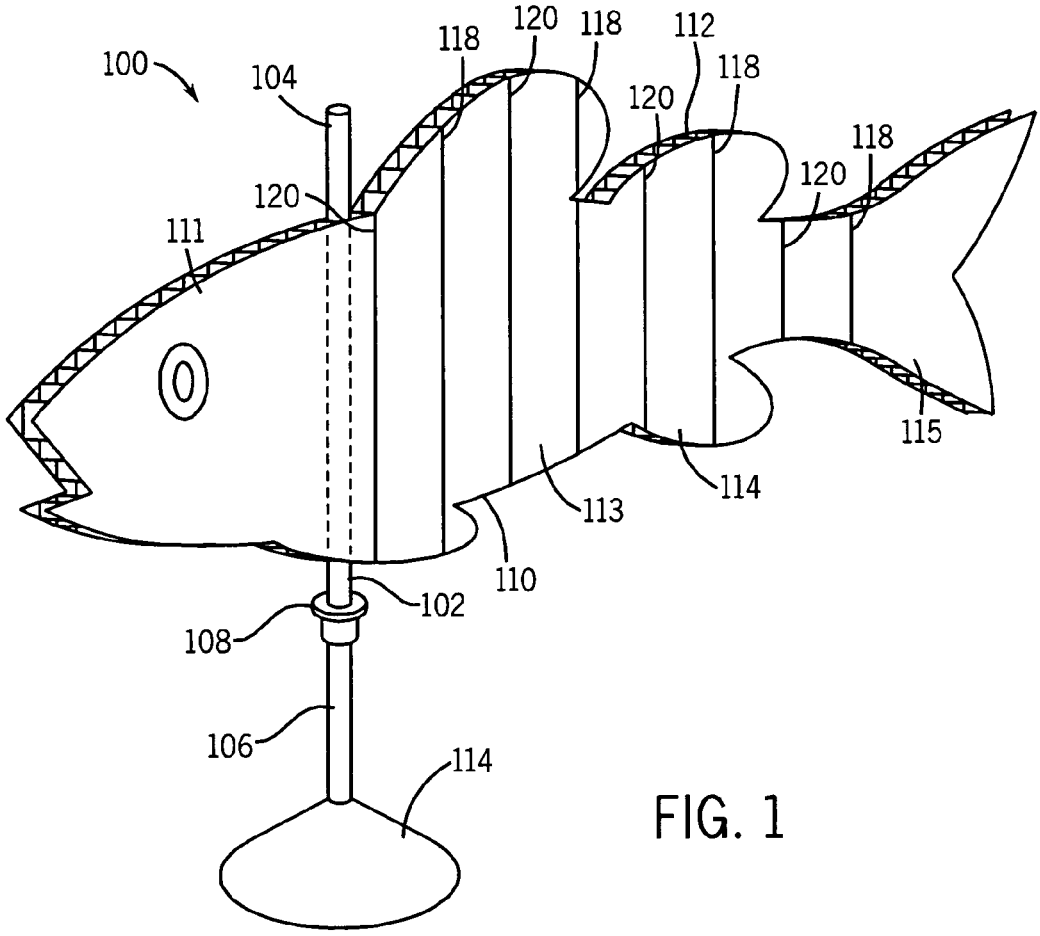
FIG. 1 is a perspective view of a mobile made in accordance with the present invention.
Figure 2:
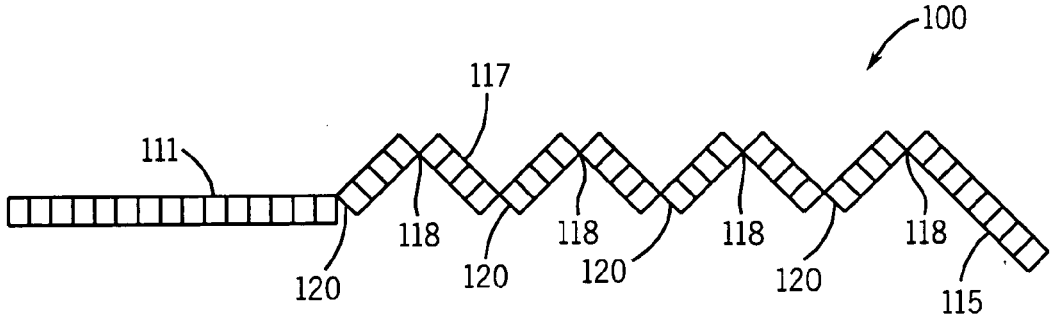
FIG. 2 is a dorsal plan view of the mobile of FIG. 1.

Referring now to FIGS. 1 and 2, there is shown an ornamental display 100 comprising a decorative mobile 110, shown here as a fish, mounted on a support rod 102.

In the preferred embodiment, the mobile 110 is a cut-out from a four millimeter corrugated plastic sheet, such as Coroplast® (Great Pacific Enterprises, Dallas, Tex.), although a sheet of any "airy" lightweight material, such as cardboard, synthetic resinous plastic, or foam having skin on each side could be used. Preferably, the cuts are made in corrugation voids of a plastic sheet.

The sheet of material is cut into form using a die-cut machine or other device. In the present example, the cut-out/blank is basically a two-dimensional fish having a head 111, a body 113, and a tail 115.

Figure 3:
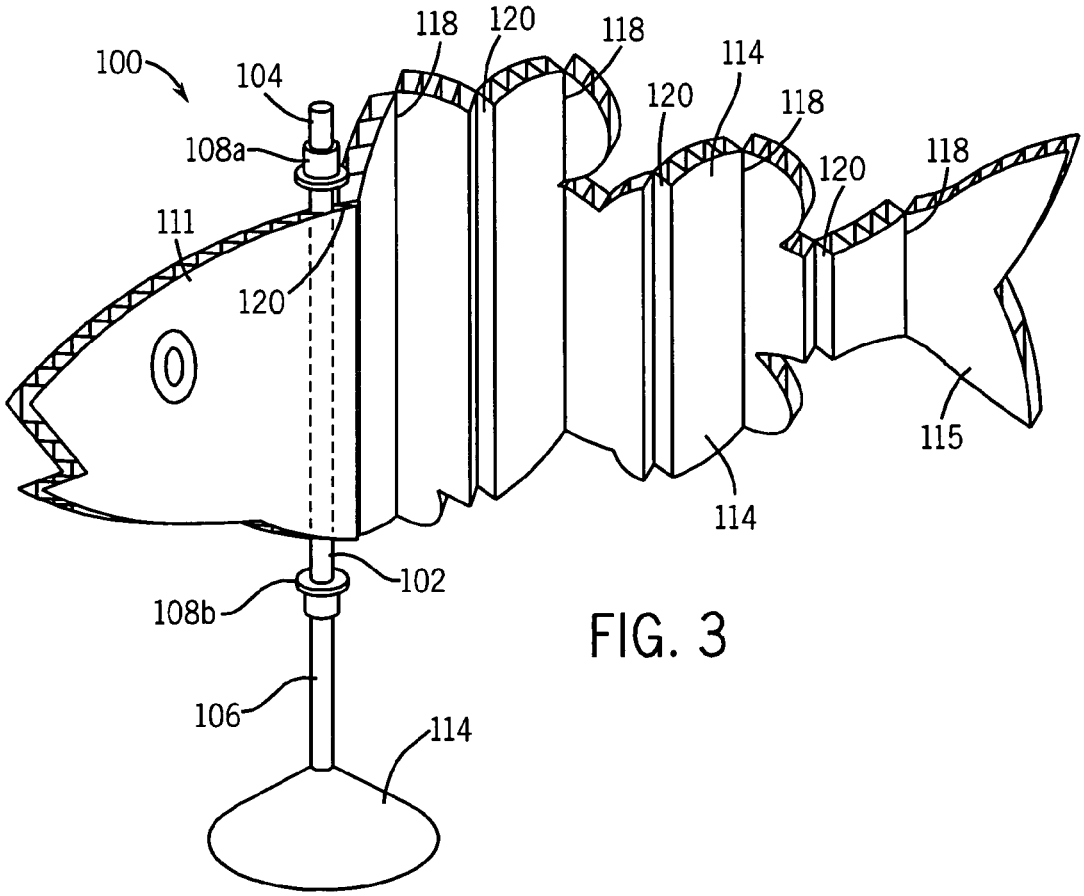
FIG. 3 is a perspective view showing segments of the mobile of FIG. 1 rotated about adjoining fold lines.

After the sheet is cut, the fold lines 118 and cut lines 120 are added. In one preferred embodiment, the fold lines 118 and cut lines 120 are added to the mobile 110 by hand, using a hand-held utility knife or razor blade such as a guide-mounted Stanley Fat Max® Utility Knife (Stanley Tools, Model Number 10-799, Farmington, Conn.), providing accurate placement and depth of the cut lines 120. As best seen in FIG. 3, the pattern of fold lines 118 and cut lines 120 in the single-piece corrugated plastic sheet provides a series of panels or segments connected at fold lines 118 (also referred to as hinge points). In an alternate embodiment, for additional support one or more hinge(s) are attached to two adjacent panels along the fold line.

The fold lines 118 and cut lines 120 are preferably spaced in an approximately equidistant manner from one another. For example, for fish having a length of 30 inches, it is preferred that the fold line 118 and cut lines 120 are approximately one inch apart. However, the spacing of the fold lines 118 and cut lines 120 can be varied depending in the shape and/or length of the object, or wind conditions. For example, if the intended display area of the display apparatus 100 has very low wind currents, the fold lines 118 and cut lines 120 may be spaced closer together along the body 113 of the mobile 110 for increasing undulations. Alternatively, if the intended display area has extremely high wind currents, the fold lines 118 and cut lines 120 can be spaced farther apart along the body section 113 of the mobile 110 to reduce undulation frequency. Panel width can be varied for other purposes as well. For example, referring to FIGS. 1 and 3, cut lines 120 are absent in the head section 111 and tail section 115 for aesthetic purposes.

In an alternate embodiment, fold lines 118 and cut lines 120 are made before the mobile 110 is cut into shape. For example, a section of plastic sheet is positioned under a die-cut machine. The operator moves the die-cut machine down to produce cut lines 120 on one side of the body 113. After the cut lines 120 on one side are made, the operator flips the plastic sheet over to the opposing side and maneuvers the sheet so that cut lines 120 on the first side alternate with the cut lines 120 on the second side. The sheet is then cut into the desired mobile shape.

After the cutting is complete, the "blanks" are decorated with a weather resistant finish applied by airbrush to give the mobile the desired appearance.

In an alternate embodiment, an assembly of panels of a solid material, such as wood, sheet metal, or acrylic, are connected by hinges to form the body of the mobile and provide articulation. In another embodiment, fabric is stretched over metal frame segments, the fabric between segments acting as the hinge.

Preferably a support rod 102 and stopper 106 are assembled to support the mobile 110 for display. The mobile is mounted on a rod and, in conjunction with a stopper, allows the mobile to pivot. The first end 104 of the support rod 102 is inserted through the interior 112 of the mobile 110. When the mobile 110 is positioned on the support rod 102, it is secured with at least one stopper 108. The second end 106 of the support rod 102 may then be inserted into the ground or other penetrable floor medium.

The support rod 102 is preferably formed from wire or fiberglass but can be formed from another suitable material such as wood, metal or plastic. If the support rod is partially flexible, the mobile may sway in the wind, further stimulating natural movements of an animal.

The position of the mobile 110 on the support rod 102 may vary. The optimal position may be determined by the surrounding wind or water. For example, when displayed in high winds, it may be preferable to place the mobile 110 near the bottom end of the support rod 102, as excess winds or water currents may cause the mobile 110 to flap excessively.

There are a number of ways to fix the mobile 110 to the support rod. The mobile 110 may be adhesively secured directly to the support rod 102 or may be attached by other securing means such as a clamp or stopper. For example, a ball-and-socket or plug-and-socket type clamp may be used. In the preferred embodiment, the mobile 110 is attached to the support rod 102 by an upper 108(*a*) stopper and a lower 108(*b*) stopper. If moveable stoppers are used, the distance of the mobile from the ground may be easily changed. In the preferred embodiment, the lower stopper 108(*b*) is a friction fitting compressed onto the rod as a permanent fixture. The stoppers may be made of rubber, plastic, or other material suitable to support the mobile on the rod.

In an alternate embodiment of the invention, a base structure 114 is provided so that the mobile may be displayed in areas where insertion of the support rod 102 into a medium is not possible, such as a concrete parking lot or wood patio. The base structure 114 may be made of wood, metal, or other material heavy enough to withstand mobile undulations. In addition, the base structure 114 may be configured to accept multiple support rods. For example, one or more holes provided in the base to support multiple support rods.

Although the mobile has been discussed with reference to movement caused by wind, the mobile 110 may also be displayed underwater, such as in a fish tank, and undulate with water movement.

It is understood that the invention is not confined to the particular construction and arrangement of parts herein illustrated and described, but embraces such modified forms thereof as come within the scope of the following claims.

We claim:

1. A mobile comprising a sheet having a series of elongated parallel passages defined between spaced opposing sheet faces, the mobile including a series of adjacent panels defined in the sheet, wherein adjacent panels share:

a. a cut line on one of the sheet faces between the adjacent panels, the cut line being formed into the sheet face along the length of one of the passages, b. a fold line on the opposite sheet face, and c. a support rod extending from one of the panels, whereby adjacent panels are foldable with respect to each other along the fold lines.

2. The mobile of claim 1 wherein each panel includes several of the passages therein.

3. The mobile of claim 1 wherein the sheet is formed of plastic.

4. The mobile of claim 1 wherein:

a. the sheet faces:

(1) are parallel, and (2) are separated by regularly spaced bridges; and b. each passage is defined:

(1) between the sheet faces, and (2) between adjacent bridges.

5. The mobile of claim 4 wherein the bridges extend at least substantially perpendicularly to the sheet faces.

6. The mobile of claim 4 wherein the bridges are evenly spaced across the entirety of each panel.

7. The mobile of claim 1 wherein the support rod extends into one of the passages between the opposing sheet faces.

8. The mobile of claim 7 wherein the support rod is rotatable within the passage, whereby the panel is pivotable about the support rod.

9. The mobile of claim 1 wherein each cut line is spaced from an adjacent cut line on the same sheet face by a fold line defined on the same sheet face.

10. A mobile comprising a sheet defined by:

a. spaced front and back sheet faces, b. a series of adjacent elongated parallel passages defined between the front and back sheet faces, and c. elongated parallel bridges extending between the front and back sheet faces, the bridges separating adjacent passages;

wherein the sheet includes:

(1) a series of panels defined along the sheet by cut lines, each cut line extending into one of the front and back sheet faces and into one of the passages to extend along the length of the passage, and (2) a support rod extending from one of the panels.

11. The mobile of claim 10 wherein the support rod extends into one of the passages between adjacent bridges.

12. The mobile of claim 11 wherein the support rod is rotatable within the passage.

13. The mobile of claim 10 wherein the bridges are evenly spaced across the entirety of each panel.

14. The mobile of claim 10 wherein the sheet is formed of corrugated plastic.

15. The mobile of claim 10 wherein the bridges extend at least substantially perpendicularly to the sheet faces.

16. The mobile of claim 15 wherein the sheet faces are parallel.

17. The mobile of claim 10 wherein adjacent cut lines on one of the sheet faces are spaced by a fold line defined on the same sheet face, with the fold line being opposite a cut line defined on the opposing sheet face.

18. A mobile comprising:

a. a sheet defined by:

(1) opposing parallel front and back sheet faces, (2) a series of elongated parallel bridges spacing the front and back sheet faces, wherein adjacent bridges are spaced to define elongated parallel passages between the front and back sheet faces and between the bridges;

the sheet including a series of panels adjacently defined along the sheet, wherein:

i. each panel includes several of the passages therein, and ii. adjacent panels are connected by only one of the front and back sheet faces; and b. a support rod extending from one of the panels.

19. The mobile of claim 18 wherein the support rod is rotatably situated within one of the passages between opposing adjacent ones of the bridges.

* * * * *